US011234521B2

(12) United States Patent
Vinje et al.

(10) Patent No.: US 11,234,521 B2
(45) Date of Patent: Feb. 1, 2022

(54) FOLDABLE CAMPING SEAT

(71) Applicant: RM BRANDS AS, Oslo (NO)

(72) Inventors: Martin Vinje, Jar (NO); Rene Kjølsrud, Oslo (NO); Bai Daniel Ødegaard Kanu, Oslo (NO); Martin Otto Fougner, Oslo (NO)

(73) Assignee: RM BRANDS AS, Oslo (NO)

( * ) Notice: Subject to any disclaimer, the term of this patent is extended or adjusted under 35 U.S.C. 154(b) by 0 days.

(21) Appl. No.: 17/048,781

(22) PCT Filed: Apr. 23, 2019

(86) PCT No.: PCT/NO2019/000012
§ 371 (c)(1),
(2) Date: Oct. 19, 2020

(87) PCT Pub. No.: WO2019/203653
PCT Pub. Date: Oct. 24, 2019

(65) Prior Publication Data

US 2021/0177145 A1 Jun. 17, 2021

(30) Foreign Application Priority Data

Apr. 19, 2018 (NO) ..... 20180534

(51) Int. Cl.
*A47C 1/14* (2006.01)
*A47C 1/16* (2006.01)
(Continued)

(52) U.S. Cl.
CPC ..... *A47C 1/146* (2013.01); *A47C 1/16* (2013.01); *A47C 4/30* (2013.01); *A47C 4/52* (2013.01); *A47C 7/282* (2013.01); *A47C 7/62* (2013.01)

(58) Field of Classification Search
CPC .. A47C 1/16; A47C 1/146; A47C 4/30; A47C 4/52; A47C 7/282; A47C 7/62
(Continued)

(56) References Cited

U.S. PATENT DOCUMENTS 1,140,997 A * 5/1915 Minehart ..... A47C 1/146 190/8
1,625,106 A * 4/1927 Sullivan ..... A47C 1/16 297/351
(Continued)

FOREIGN PATENT DOCUMENTS

DE 202012009962 U 2/2013
EP 2110051 A1 * 10/2009 ..... A47C 7/445
(Continued)

OTHER PUBLICATIONS

International Searching Authority, International Search Report in International Application No. PCT/NO2019/000012, dated Sep. 2, 2019.
(Continued)

*Primary Examiner* — Robert Canfield
(74) *Attorney, Agent, or Firm* — Leydig Voit & Mayer, Ltd.

(57) ABSTRACT

A foldable camping seat is disclosed comprising a flexible seat with at least one bracing on each side extending in the entire longitudinal direction of the seat, a flexible seat back with at least one bracing on each side that extends the entire height of the seat back, furthering comprising at least one flexible and tension resistant connection between the seat and the seat back on each side which is attached directly or indirectly to the bracings near the respective outer ends thereof, wherein the inner end of the seat and the lower end of the seat back meets in a straight line forming a pivot axis between the seat and the seat back. At least one elastic zone
(Continued)

comprising an elastic material is mounted in the upper part of the seat back.

15 Claims, 2 Drawing Sheets

(51) Int. Cl.
*A47C 7/28* (2006.01)
*A47C 4/52* (2006.01)
*A47C 4/30* (2006.01)
*A47C 7/62* (2006.01)

(58) Field of Classification Search
USPC ..... 297/351, 380, 452.12, 452.13, 452.56, 297/188.04
See application file for complete search history.

(56) References Cited

U.S. PATENT DOCUMENTS 2,367,450 A * 1/1945 Trubitz ..... A47C 31/11 297/224
2,463,049 A * 3/1949 Onsa ..... A47C 4/30 4/517
2,532,713 A * 12/1950 Gottfried ..... A47C 7/282 160/388
2,704,569 A * 3/1955 Salzer ..... A47C 4/30 160/378
3,669,489 A * 6/1972 Rock ..... A47C 4/52 297/129
3,825,298 A * 7/1974 Chipman ..... A47C 1/146 297/129
3,902,756 A * 9/1975 Chubb ..... A47C 7/22 297/452.56
3,981,538 A * 9/1976 Chubb ..... A47C 5/06 297/452.13
4,077,669 A * 3/1978 Fox ..... A47C 7/282 297/452.1
4,824,171 A 4/1989 Hollingsworth
4,910,817 A * 3/1990 Kita ..... B29C 53/36 5/246
5,190,350 A * 3/1993 Hwang ..... A47C 3/16 297/380
5,620,227 A * 4/1997 Brune ..... A41D 15/04 297/4
6,120,097 A * 9/2000 Perry ..... A47C 3/12 297/229
6,315,364 B1 * 11/2001 Fujita ..... A47C 7/24 297/452.56
6,848,746 B2 * 2/2005 Gentry ..... A47C 7/021 297/380
9,095,228 B2 * 8/2015 Gooris ..... B62B 9/108
9,596,939 B1 * 3/2017 Helman ..... A45C 9/00
10,631,619 B2 * 4/2020 Alphin ..... A47C 1/146
2005/0248189 A1 * 11/2005 Prasatek ..... B60N 2/68 297/188.04
2007/0152479 A1 * 7/2007 Howman ..... A47C 7/021 297/180.11
2009/0090751 A1 * 4/2009 D'Alessandro ..... A45F 4/02 224/155
2019/0090643 A1 * 3/2019 Mason ..... A47C 7/142

FOREIGN PATENT DOCUMENTS

GB 590697 A * 7/1947 ..... A47C 1/146
GB 590697 A 7/1947
GB 909850 A * 11/1962 ..... A47C 7/282
GB 1119818 A * 7/1968 ..... A47C 7/44
GB 1476493 A * 6/1977 ..... B60R 7/043
GB 2250679 A 6/1992
JP 3170312 U * 9/2011 ..... A47C 4/28
WO 2012/054940 A1 4/2012

OTHER PUBLICATIONS

International Searching Authority, Written Opinion in International Application No. PCT/NO2019/000012, dated Sep. 2, 2019.
Norwegian Patent Office, Office Action in Counterpart Norwegian Patent Application No. 20180534, dated Nov. 17, 2018.

* cited by examiner

FOLDABLE CAMPING SEAT

CROSS-REFERENCE TO RELATED APPLICATIONS

This patent application is the U.S. National Stage of International Patent Application No. PCT/NO2019/000012, filed Apr. 23, 2019, which claims the benefit of Norwegian Patent Application No. 20180534, filed Apr. 19, 2018, which are each incorporated by reference.

FIELD OF THE INVENTION

The invention relates to a seating device, more specifically to a seat which is lightweight, foldable and which is suitable for bringing along anywhere.

BACKGROUND

Today, camping chairs is a large market with many different types of chairs and designs. The trend in the development is that the camping chairs become smaller, lighter and put higher demands on package friendliness. Camping chairs and recliners usually come as "one size" and will not be ergonomically correct for most of the users. 'Crazy Creek' has since the 1980's sold a camping seat (without legs), which they have called 'The Original Chair' consisting of a seat, a seat back and a strap on each side that holds the seat back at a fixed angle. This is one of the most compact seat solutions on the market that does not depend on being hung up or supported in any way. We would like to offer a more adapted and ergonomically correct sitting position for those who use such compact seats. Due to the shape of the body, especially the lower back and buttocks, there is an angle between the back and the seat back so that in most cases the user of a camping seat will experience that the back rests against the upper part of the seat back. This will gnaw over time and reduce comfort. Especially a larger person will feel uncomfortable and the upper back and the corners will be able to "stick" into the back.

A camping seat as described solves this problem.

SUMMARY OF THE INVENTION

The invention describes a foldable camping seat which comprises a flexible seat with at least one bracing on each side extending in the entire longitudinal direction of the seat, a flexible seat back with at least one bracing on each side extending throughout the height of the seat back.

Furthermore, the camping seat comprises at least one flexible, but tension resistant connection between the seat and the seat back which is attached to the bracings on either side near the respective outer ends thereof. The inner end of the seat and the lower end of the seat back meet in a straight line forming a pivot axis between the seat and the seat back. The invention is characterized in that at least one elastic zone comprising an elastic material is mounted in the upper part of the seat back.

BRIEF DESCRIPTION OF THE FIGURES

In order to better understand the invention, some figures are enclosed in which like numbers in different figures represent the same features.

DETAILED DESCRIPTION

The camping seat has an unfolded and folded state. The text refers to the seat standing in the correct position for use and in the unfolded state.

Figure 1:
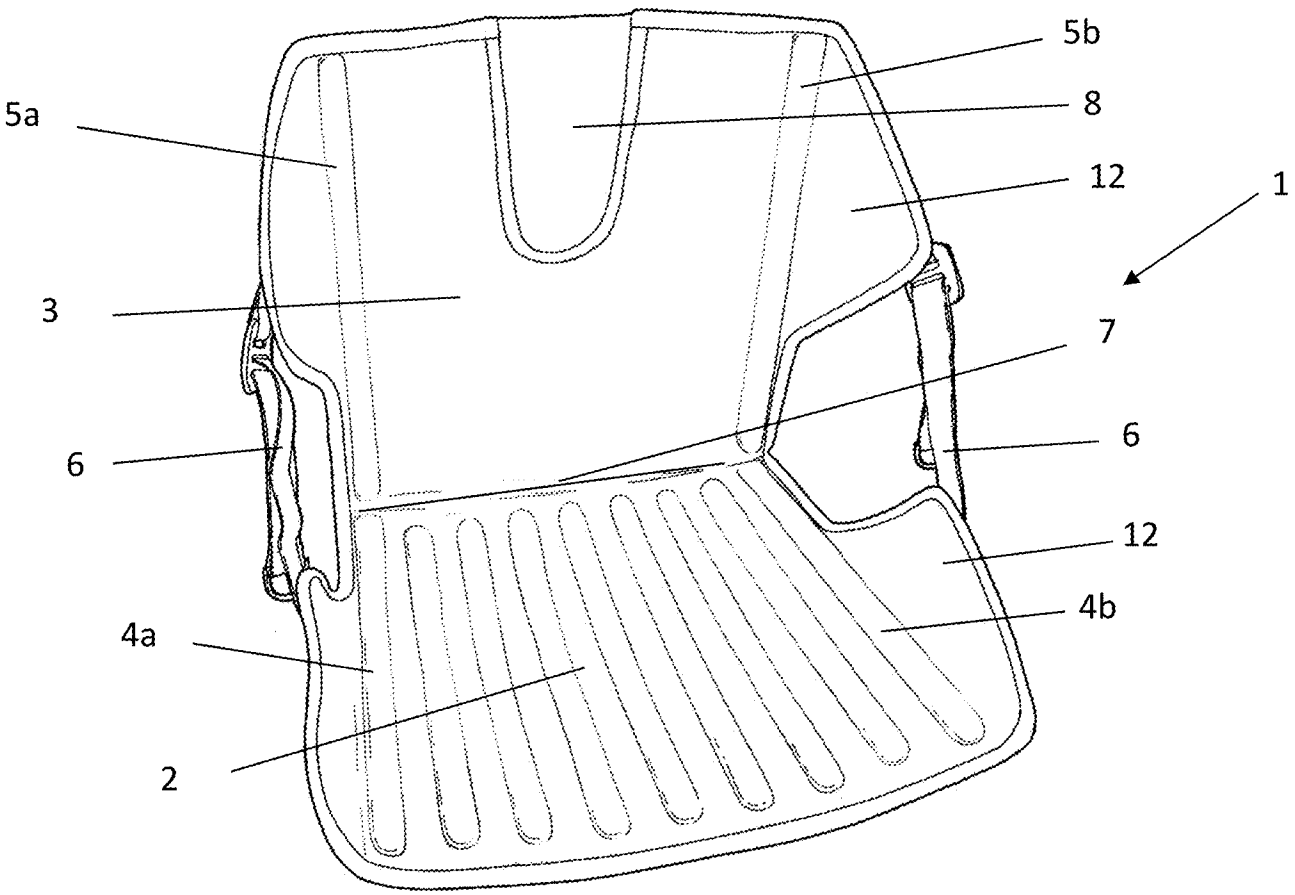
FIG. 1 shows the camping seat seen from the front.

The foldable camping seat 1 comprises a flexible seat 2 with at least one bracing 4*a*, 4*b* on each side of the seat extending in the entire longitudinal direction of the seat as shown in FIG. 1. Further, the seat comprises a flexible seat back 3 with at least one bracing 5*a*, 5*b* on each side of the seat back that extends throughout the height of the seat back. The camping seat includes also at least one flexible but tension resistant connection 6 between the seat and the seat back which is attached directly or indirectly to the bracings 4*a*, 4*b*, 5*a*, 5*b* on each side near the respective outer ends thereof. The inner end of the seat and the lower end of the seat back meet in a straight line forming a pivot axis 7 between the seat and the seat back.

The invention is characterized in that at least one elastic zone 8 is mounted in the upper part of the seat back. By adding an elastic zone in the back it is possible to have a more standardized design of the back part on chairs that will feel comfortable for more types and sizes of people.

In one embodiment, the tension-resistant connections are attached to ears 12, which in turn are attached to the bracings. This distributes the tensile forces on the bracings 4*a*, 4*b*, 5*a*, 5*b*, so that their dimensions can be made smaller. Another advantage of ears 12 is that they prevent snow and rubbish from entering the seat 2 of the camping seat.

The elastic zone 8 causes two important effects: one is that the angle of the seat back relative to the seat changes and thus follows the back of the user so that a larger part of the back of the user is in contact with the seat back in the vertical direction. The second is that the width of the seat back 3 increases so that the braces 4*a*, 4*b*, 5*a*, 5*b* are pulled slightly forward along the side of the user so that a larger part of the back and sides of the user are in contact with the seat back in the horizontal direction.

An additional elastic zone (not shown) may be located in an outer portion of the seat. In a similar manner to the seat back, the elastic zones in the seat will cause the user to not notice the edge of the seat against the underside of the thighs.

Figure 2:
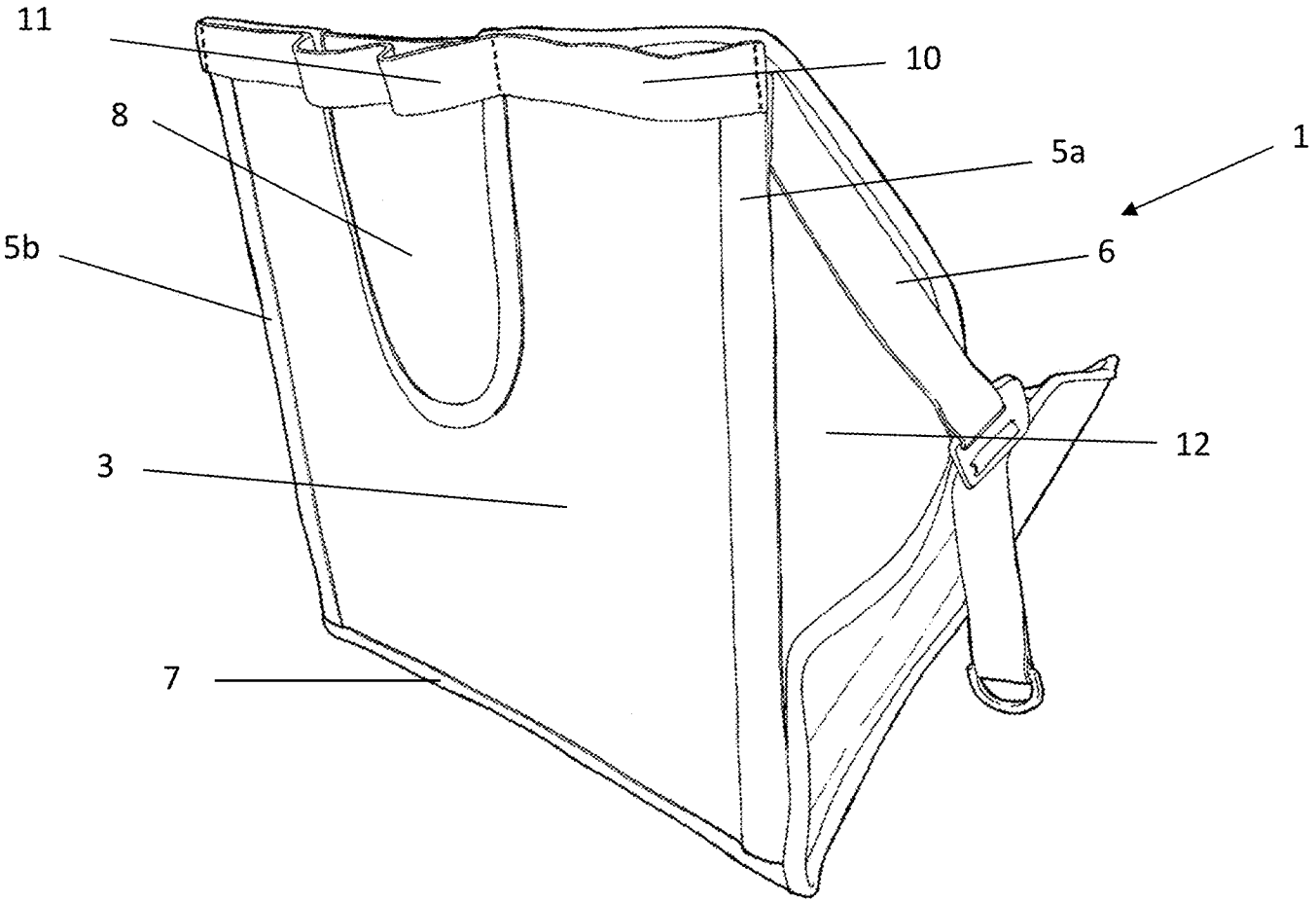
FIG. 2 shows the camping seat seen from behind

The elastic zone may have different shapes such as a rectangle, a V-shape, a U-shape, the shape of the lower part of an ellipse or a combination thereof. A rounded V-shape with a width of 5-10 cm at the top and a height of 10-15 cm appears to be a favorable dimension in a seat intended for an adult. Advantageously, a tension strap 10 can be attached along the upper edge of the seat back which includes a loop 11 which prevents the elastic material of the elastic zone 8 from being overstretched (see FIG. 2).

In one embodiment, the camping seat has a bracing (not shown) in the pivot axis 7. Then it is not possible to roll the seat together unless the bracing is removed. In a second embodiment, there is no bracing in the pivot axis 7. Then the camping seat can first be folded so that the seat and the seat back lie on top of each other and then rolled sideways, or optionally folded so that the seat can be carried as a relatively compact unit, for example wrapped in a cover or with straps around.

The elastic zone itself can be placed in the seat back at the top center. Other locations are also possible, but probably less functional. In order for the elastic zone to distribute the weight of the user, it should be positioned where the user's back hits the back of the seat during normal use. The zone will stretch depending on the size of the person and the weight of the person.

The elastic zone 8 can be designed differently and in one embodiment of the invention the elastic zone in the middle and upper part of the back part comprises a fabric which extends asymmetrically. For example it extends more in the width direction (horizontally) than in the height direction (vertically). An example of a stretch zone can be a fabric that extends 50% in width and 20% in height. At a backrest of 40×40 cm with 10×20 cm placed in the middle at the top, the back can expand to 45 cm in width and 44 cm in height. This allows a large person to have more room for his/her back.

In one embodiment, the elastic zone 8 comprises elastics or elastic bands which are attached to each side of the elastic zone. Elastics can have more tension than a stretch fabric and the stretching zone can therefore be made smaller in width (at unloaded seat back).

The stretch material can be sewn, glued or welded to the material of the seat back. The elastic zone comprises elastic straps/straps, and may be secured by a Velcro/Velcro, clamps, buttons, or the like.

INVENTORY

1 Camping seat
2 Seat
3 Seat back
4*a*, 4*b* Bracings for seat
5*a*, 5*b* Bracings for seat back
6 Tension resistant connection
7 Pivot axis
8 Elastic zone
10 Tension strap
11 Loop
12 Ears

The invention claimed is:

1. A foldable camping seat comprising:

a flexible seat having at least one flexible seat bracing on each side extending in substantially an entire longitudinal direction of the flexible seat;

a flexible seat back with at least one flexible seat back bracing on each side extending substantially an entire height of the flexible seat back, the flexible seat back having a width;

at least one flexible tension resistant connection between the flexible seat and the flexible seat back on each side which is attached directly or indirectly to the at least one flexible seat bracing and at least one flexible seat back bracing respective outer ends of the flexible seat and flexible seat back thereof;

the flexible seat having an inner end, and the flexible seat back having a lower end and an upper part where the inner end of the flexible seat and the lower end of the flexible seat back meet in a straight line forming a pivot axis between the flexible seat and the flexible seat back, further comprising at least one elastic zone comprising an elastic material mounted in the upper part of the flexible seat back such that a weight of a user of the foldable camping seat is distributed and the width of the flexible seat back is increased such that the at least one seat back bracing on each side is pulled forward along sides of the user causing a larger part of a back and the sides of the user to be in contact with the flexible seat back.

2. The foldable camping seat according to claim 1, wherein the at least one elastic zone has a shape of a rectangle, a V, a U, a lower part of an ellipse, or a combination thereof.

3. The foldable camping seat according to claim 2, where in the flexible seat and the flexible seat back include a textile material.

4. The foldable camping seat according to claim 2, wherein the at least one flexible seat bracing and at least one flexible seat back bracing are splines which are secured in pockets of material of the flexible seat and flexible seat back.

5. The foldable camping seat according to claim 2, wherein the at least one flexible tension resistant connection is an adjustable strap.

6. The foldable camping seat according to claim 2, wherein the at least one flexible tension resistant connection is attached to an ear, which in turn is attached to the braces at least one flexible seat bracing and at least one flexible seat back bracing.

7. The foldable camping seat according to claim 1, wherein the flexible seat and the flexible seat back include a textile material.

8. The foldable camping seat according to claim 7, wherein the at least one flexible seat back bracing are splines which are secured in pockets of material of the flexible seat and flexible seat back.

9. The foldable camping seat according to claim 7, wherein the at least one flexible tension resistant connection is an adjustable strap.

10. The foldable camping seat according to claim 1, wherein the at least one flexible seat bracing and at least one flexible seat back bracing are splines which are secured in pockets of material of the flexible seat and flexible seat back.

11. The foldable camping seat according to claim 10, wherein the at least one flexible tension resistant connection is an adjustable strap.

12. The foldable camping seat according to claim 1, wherein the at least one flexible tension resistant connection is an adjustable strap.

13. The foldable camping seat according to claim 1, wherein the at least one flexible tension resistant connection is attached to an ear, which in turn is attached to the at least one flexible seat bracing and at least one flexible seat back bracing.

14. The foldable camping seat according to claim 1, where the elastic material is sewn, glued or welded to the material of the seat back.

15. The foldable camping seat according to claim 1, wherein the at least one elastic zone comprising an elastic material is mounted in the middle upper part of the flexible seat back.

* * * * *